US006786770B1

(12) United States Patent
Huang

(10) Patent No.: US 6,786,770 B1
(45) Date of Patent: Sep. 7, 2004

(54) SHIELDED ELECTRICAL CONNECTOR

(75) Inventor: Chien-Hsun Huang, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/459,205

(22) Filed: Jun. 10, 2003

(30) Foreign Application Priority Data

May 7, 2003 (TW) ..... 92208367 U

(51) Int. Cl.[7] ..... H01R 13/648
(52) U.S. Cl. ..... 439/607
(58) Field of Search ..... 439/607–610

(56) References Cited

U.S. PATENT DOCUMENTS 5,102,353 A * 4/1992 Brunker et al. ..... 439/608
6,193,555 B1 * 2/2001 Chang ..... 439/608
6,224,422 B1 * 5/2001 Zhu et al. ..... 439/607
6,554,642 B1 4/2003 Xiang et al.

* cited by examiner

*Primary Examiner*—Ross Gushi
(74) *Attorney, Agent, or Firm*—Wei Te Chung

(57) ABSTRACT

An electrical connector (100) includes an insulative housing (1), a number of contacts (3), a front shielding member (4), a rear shielding member (5), and a fastener. The insulative housing includes opposite front and rear walls (13, 14), and opposite top and bottom walls (11, 12) connecting to the front and rear walls. The contacts are received in the insulative housing and each includes a section exposed outside of the rear wall of the insulative housing. The front shielding member is attached to the front wall of the insulative housing and includes a rearwardly extending flange (44). The rear shielding member is attached to the rear wall of the insulative housing for covering the sections of the contacts, and includes a tab (541) engaged with the flange of the front shielding member for forming an electrical connection therebetween. The fastener fastens the insulative housing, the front and the rear shielding members together.

11 Claims, 5 Drawing Sheets

SHIELDED ELECTRICAL CONNECTOR

BACKGROUND OF THE INVENTION

1. Field of the Invention

The present invention relates to an electrical connector, and more particularly to a Digital Visual Interface (DVI) connector shielded from electromagnetic or radio frequency interference.

2. Description of the Related Art

The DVI is developed by DDWG which is the abbreviation of "Digital Display Working Group" which was organized by Intel Corporation, Silicon Image, Inc., Compaq Computer Corp., Fujitsu Limited, Hewlette-Packard Company, International Business Machines Corp., and NEC Corporation. The DVI is primarily focused on providing a connection between a computer and a display device through a high-speed DVI connector. The DVI connector ensures all content transferred over this interface remains in the lossless digital domain from creation to consumption. The DVI connector supports not only digital signals but also analog signals.

In high speed applications, EMI (Electro-Magnetic Interference) is one of the major causes for noise. Therefore, suppression of EMI is highly considered in the course of designing DVI connectors. U.S. Pat. No. 6,554,642 (the '642 patent) discloses a DVI connector. The connector comprises an insulative housing retaining a plurality of conductive contacts therein. The contacts have front and rear sections extending beyond front and rear walls of the insulative housing. A front shielding member is attached to the front side of the insulative housing for surrounding and shielding the front sections of the contacts, and a rear shielding cover is attached to the rear side of the insulative housing for shielding the rear sections of the contacts. An electrical connection is established between the front shielding member and the rear shielding cover by spring tabs of the rear shielding cover abutting against a flange of the front shielding member. Thus, the rear shielding cover is suitably grounded.

However, there is no enough and reliable retention means to secure the rear shielding cover to the insulative housing, and vibration generated in transport or mating/unmating with a complementary connector may cause the electrical connection between the front shielding member and the rear shielding cover break, resulting in poor transmission of signals.

Hence, an improved electrical connector is required to overcome the disadvantages of the prior art.

SUMMARY OF THE INVENTION

A major object of the present invention is to provide an electrical connector having a front and a rear shielding members with stable and reliable connection therebetween for preventing electromagnetic or radio frequency interference.

In order to achieve the object set forth, an electrical connector comprises an insulative housing, a plurality of contacts, a front shielding member, a rear shielding member, and a fastener. The insulative housing comprises opposite front and rear walls, opposite top and bottom walls connecting to the front and rear walls. The contacts are received in the insulative housing and each comprises a section exposed outside of the rear wall of the insulative housing. The front shielding member is attached to the front wall of the insulative housing and comprises a rearwardly extending flange. The rear shielding member is attached to the rear wall of the insulative housing for covering the sections of the contacts, and is engaged with the flange of the front shielding member for forming an electrical connection therebetween. The fastener fastens the insulative housing, the front and the rear shielding members together.

Other objects, advantages and novel features of the invention will become more apparent from the following detailed description when taken in ion with the accompanying drawings.

DETAILED DESCRIPTION OF THE INVENTION

Figure 1:
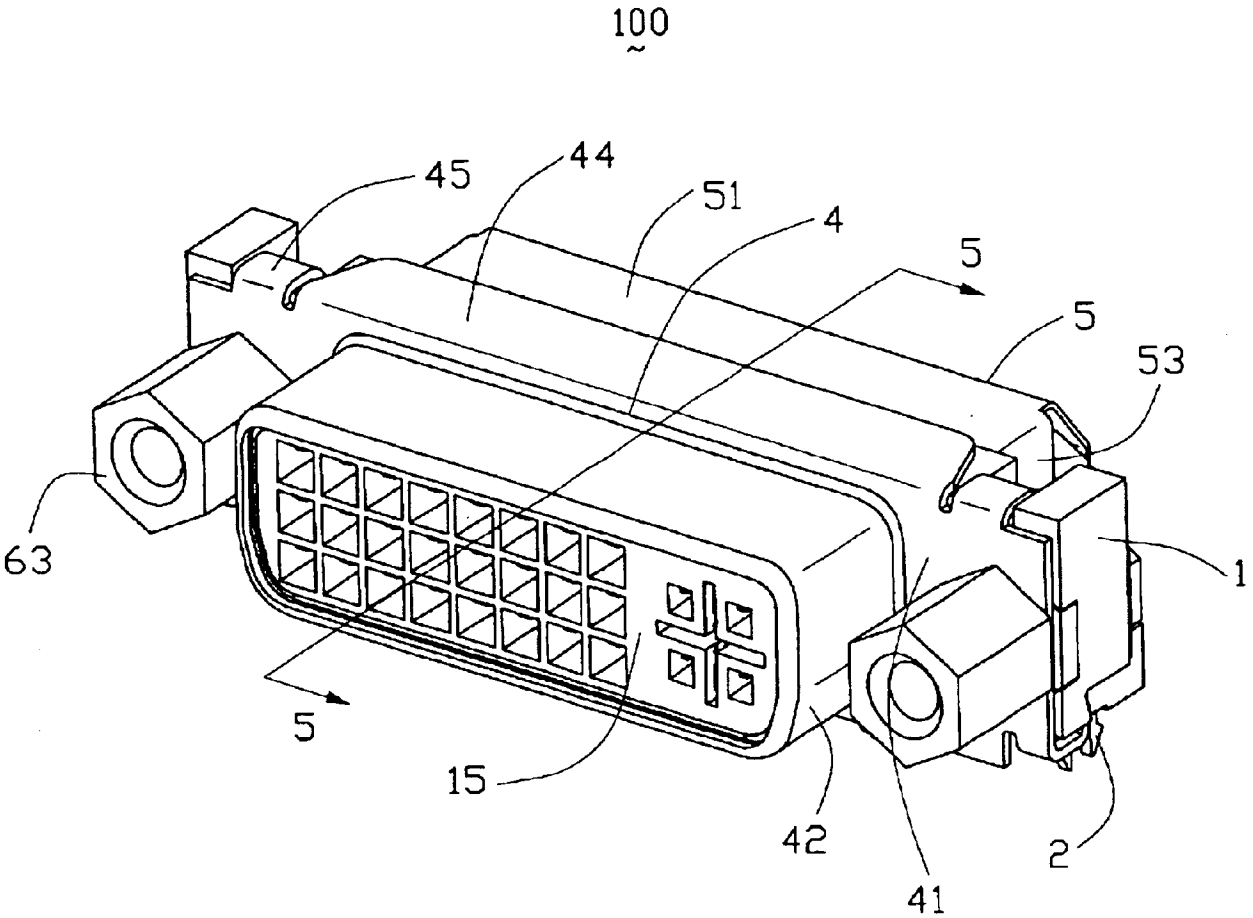
FIG. 1 is a perspective view of an electrical connector in accordance with the present invention.
Figure 2:
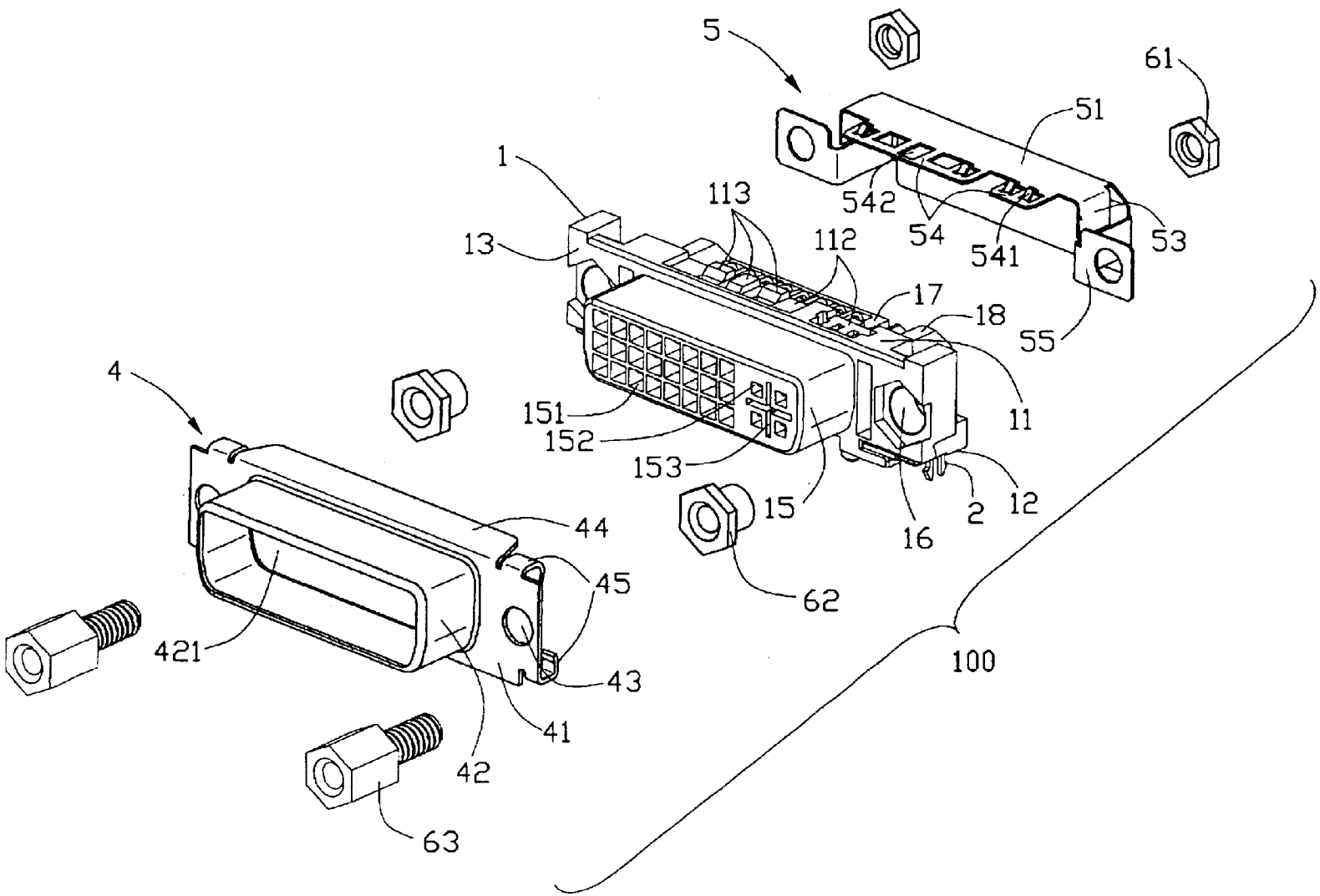
FIG. 2 is a partially exploded, perspective view of the electrical connector of FIG. 1.

Referring to FIGS. 1 and 2, an electrical connector 100 comprises an insulative housing 1, a pair of board locks 2, a plurality of conductive contacts 31, 32, 33 (see FIG. 4), a front shielding member 4, a rear shielding member 5, and a pair of fasteners.

Figure 3:
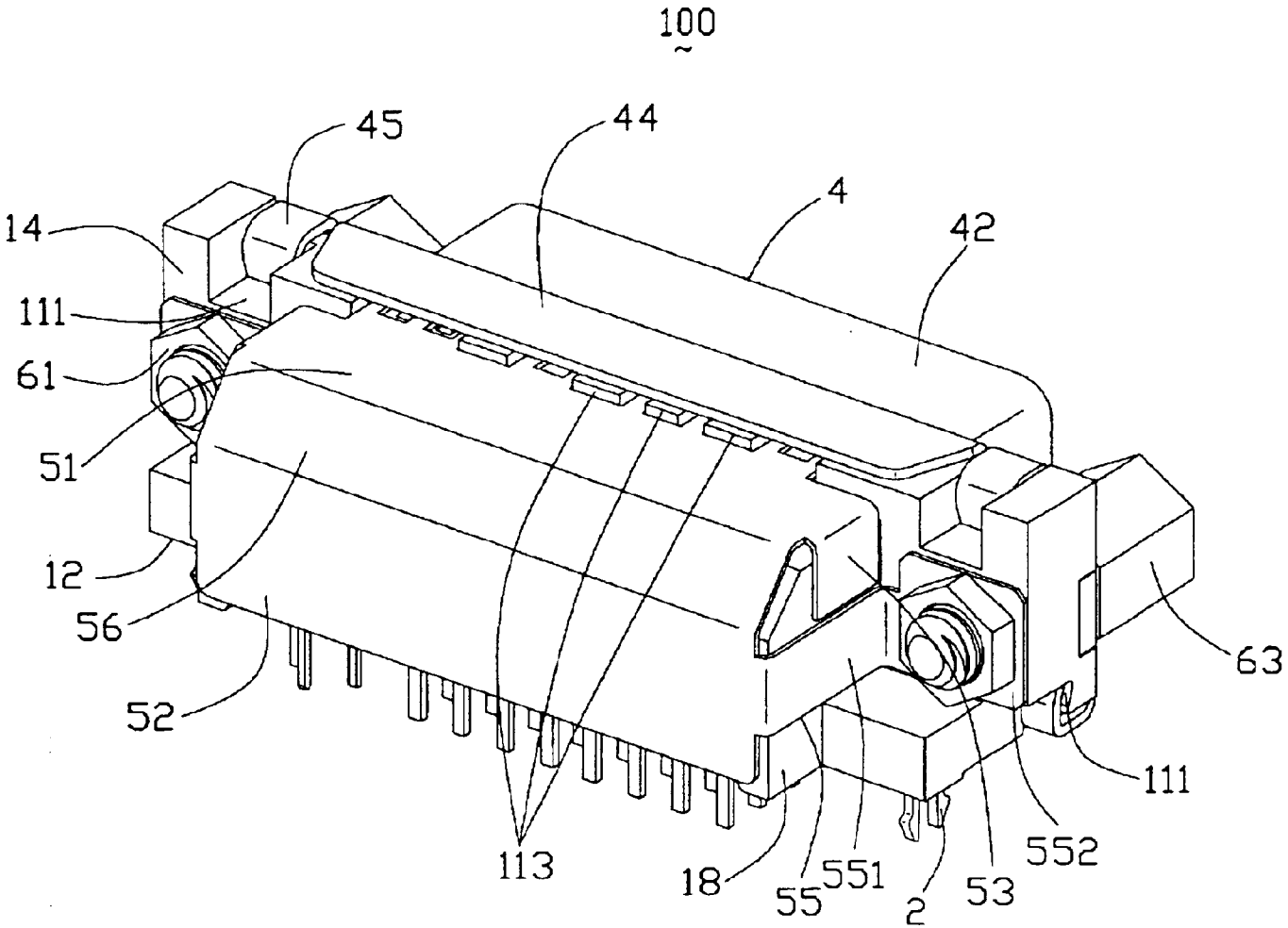
FIG. 3 is a perspective view of the electrical connector of FIG. 1 but taken from another aspect.
Figure 4:
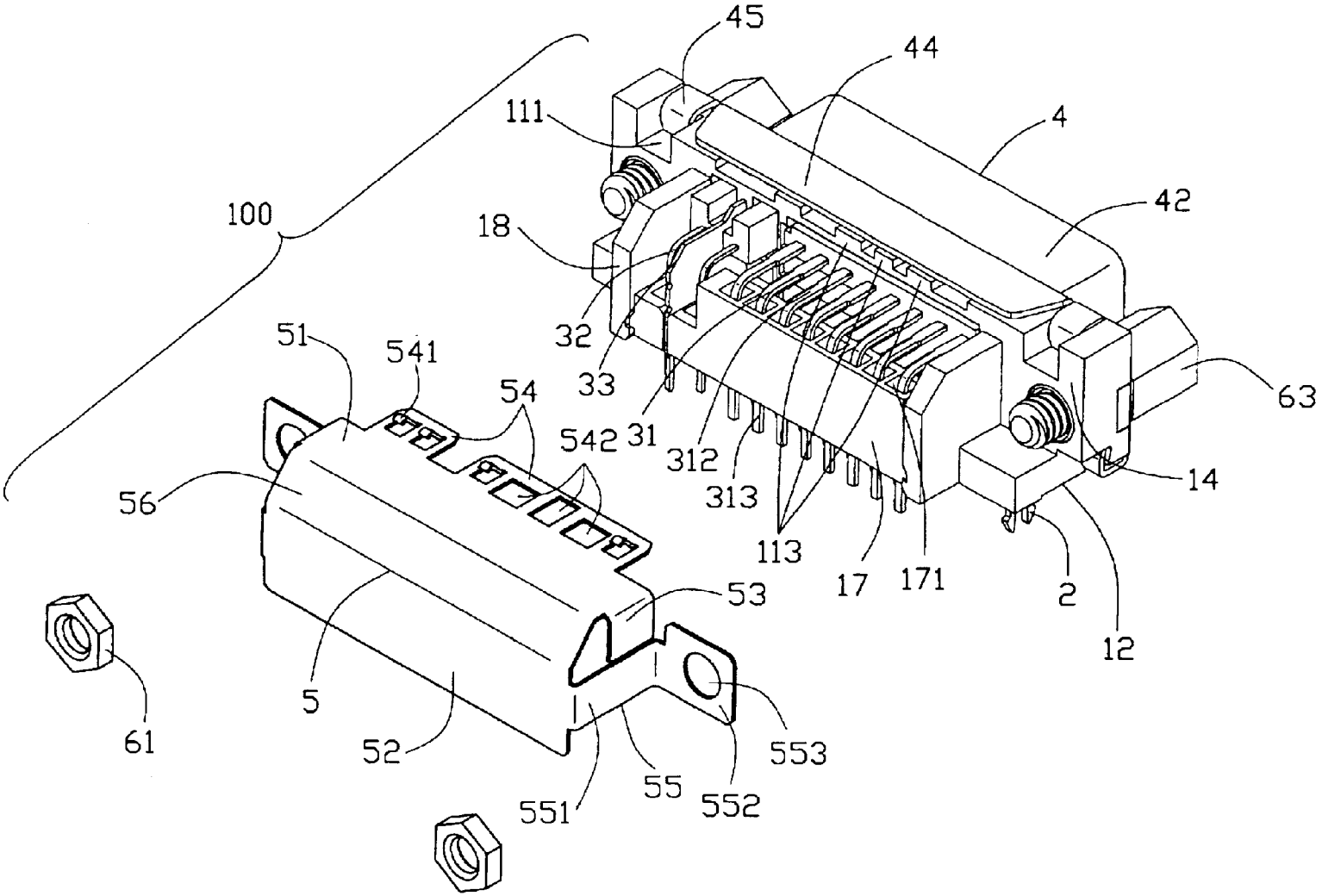
FIG. 4 is a partially exploded, perspective view of the electrical connector of FIG. 3.

The insulative housing 1 comprises a front wall 13, a rear wall 14 (see FIG. 4), and a top and bottom walls 11, 12 connecting the front and rear walls 13, 14. The insulative housing 1 comprises a projection 15 extending from the front wall 13. The projection 15 defines a plurality of first passageways 151, second passageways 152 and third passageways 153 extending through the rear wall 14 (see FIG. 4). In the embodiment illustrated, the first passageways 151 are arranged in three parallel rows, and the third passageways 153 are crossed each other and positioned between the second passageways 152. With reference to FIGS. 3 and 4, the insulative housing 1 comprises two partition walls 18 formed on the rear wall 14 of the insulative housing 1 and a spacer 17 fixed between the partition walls 18. The spacer 17 defines a plurality of fourth passageways 171 therein. Also referring to FIG. 2, the insulative housing 1 defines two bores 16 extending through the front and rear walls 13, 14 at opposite side thereof. The insulative housing 1 comprises two recesses 112 defined in the top wall 11, a plurality of protrusions 113 projecting into one recess 113, and two pairs of notches 111 respectively defined in the top and bottom walls 11.

The board locks 2 are assembled to the insulative housing 1 with legs (not labeled) thereof extending through the bottom wall 12 of the insulative housing 1. When the connector 100 is mounted onto a printed circuit board (PCB, not shown), the legs are engaged with the PCB to secure the connector 100 on the PCB.

Figure 5:
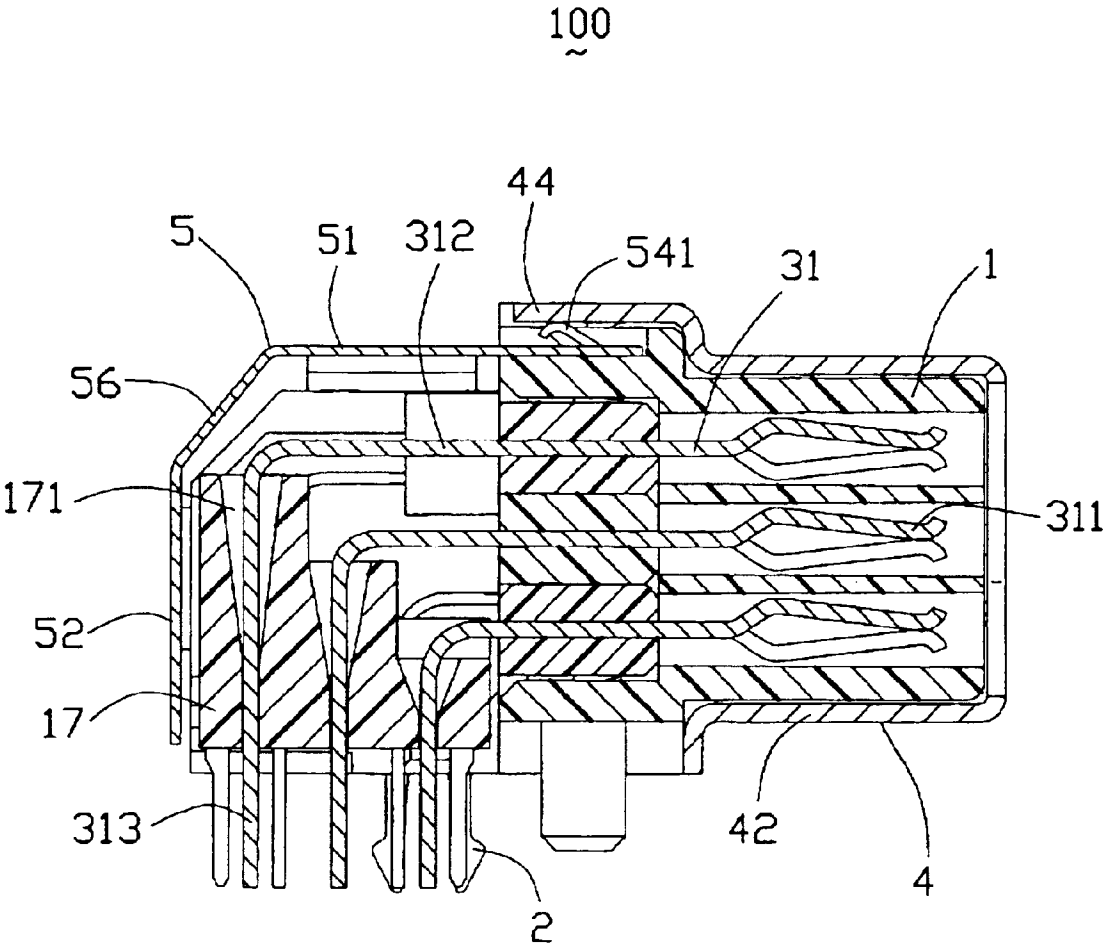
FIG. 5 is a cross-sectional view taken along line 5—5 of FIG. 1.

Referring to FIGS. 4 and 5, the contacts 3 include a number of first contacts 31 for transmitting digital signals, a number of second contacts 32 for transmitting analog signals, and third contacts 33 for grounding. Each first contact 31 has a mating section 311 received and retained in the corresponding first passageway 151, a tail section 313 extending through the corresponding fourth passageway 171 of the spacer 17, and an arc connecting section 312 connecting between the mating section 311 and the tail section 312 whereby the tail section 313 is substantially perpendicular to or inclined at a predetermined angle with respect to the mating section 313. Similarly, each second or third contact 32, 33 has a mating section (not shown) received and retained in the corresponding second or third passageway 152, 153, a tail section (not shown) extending through the corresponding fourth passageway 171, and a connecting portion (not labeled) connecting between the mating section thereof and the tail section thereof.

With reference to FIG. 2, the front shielding member 4 comprises a base plate 41 attached to the front wall 13 of the insulative housing 1 and a shroud wall 42 formed on the base plate 41 and defining a receiving room 421 for receiving the projection 15 whereby the base plate 41 covers the front wall 13 of the insulative housing 1 and the shroud wall 42 surrounds the projection 15 (see FIG. 1). The base plate 41 further comprises a pair of openings 43 corresponding to the bores 16 of the insulative housing 1, a top flange 44 extending from a top end thereof to partially overlap and cover the top wall 11 of the insulative housing 1 (see FIG. 3), and two pairs of deformable tabs 45 extending respectively from the top end and a bottom end thereof with the upper pair locating on opposite sides of the top flange 44 for being bent into and thus engaging with the notches 111 to attach the front shielding member 4 to the insulative housing 1 (see FIG. 3).

The rear shielding member 5 is attached to the insulative housing 1 for covering and shielding sections which consist of the connecting sections and the tail sections of the contact 3 exposed outside of the rear wall 14 of the insulative housing 1. In conjunction with FIGS. 3 and 4, the rear shielding member 5 comprises a top panel 51, a back panel 52 and an oblique panel 56 connecting the top and back panels 51, 52. The top panel 51 has two extending portions 54 extending from a front end thereof for being received in the recesses 112 of the insulative housing 1 and a pair of abutting plate 53 extending downwardly from opposite ends thereof for abutting against the partition wall 18. The extending portion 54 comprises a plurality of tabs 541 formed thereon to abut against the top flange 44 of the front shielding member 4 for establishing an electrical connection therebetween, and a plurality of apertures 542 defined therein to fitly receive the protrusion 19 of the insulative housing 1.

The back panel 52 is formed with a pair of wings 55 at opposite ends thereof. Each wing 55 comprises an arm portion 551 extending forwardly from opposite ends of the back panel 52 for abutting against the partition wall 18 of the insulative housing 1, and a hand portion 552 extending from and perpendicular to the arm portion 551 for abutting against the rear wall 14 of the insulative housing 1. The hand portion 552 defines an opening 553 corresponding to the bore 16 of the insulative housing 1 and the opening 43 of the front shielding member 4.

Each fastener comprises a nut 61, a sleeve 62 and a bolt 63. The sleeve 62 is received in the bore 16 of the insulative housing 1 before the front shielding member 4 is attached to the insulative housing 1. After the front and rear shielding member 4, 5 attached to the insulative housing 1, the bolt 63 extends through the opening 43 of the front shielding member 43, the sleeve 62, and the opening 553 of the rear shielding member 55 and is screwed to the nut 61 tightly.

The rear shielding member 5 is formed with a pair of wings 55 to be tightly attached to the insulative housing 1 by the fastener, and defines a plurality of apertures 542 for fitly receiving the protrusion 113 of the insulative housing 1. By this structure, the rear shielding member 5 is able to be secured on the insulative housing 1 thereby ensuring reliability and stability of the electrical connection between the front and rear shielding members 4, 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the term in which the appended claims are expressed.

What is claimed is:

1. An electrical connector comprising:

an insulating housing comprising opposite front and rear walls;

a plurality of contacts being received in the insulative housing and each comprising a section exposed outside of the rear wall of the insulative housing;

a front shielding member being attached to the front wall of the insulative housing;

a rear shielding member being attached to the rear wall of the insulative housing for covering the sections of the contacts and electrically connecting with the front shielding member; and a fastener fastening the insulative housing, the front and the rear shielding members together, the fastener comprising a sleeve secured to the housing, a bolt extending through the sleeve, and a nut screwed with the bolt.

2. The electrical connector as claimed in claim 1, wherein the front shielding member comprises a rearwardly extending top flange, and wherein the rear shielding member comprises a tab for electrically connecting with the top flange.

3. The electrical connector as claimed in claim 1, wherein the rear shielding member comprises a top panel with a plurality of apertures defined therein, and wherein the insulative housing is formed with a plurality of protrusions for being fittingly received in the apertures, respectively.

4. The electrical connector as claimed in claim 1, wherein the insulative housing comprises two partition walls formed on the rear wall thereof and a spacer disposed between the two partition walls, the spacer defining a plurality of passageways for receiving the sections of the contacts.

5. The electrical connector as claimed in claim 1, wherein the insulative housing comprises a projection formed on the front wall thereof with the contacts extending in the projection.

6. The electrical connector as claimed in claim 1, wherein the front shielding member comprises a base plate attached to the front wall of the insulative housing, a shroud wall being formed on the base plate and defining a receiving room for receiving the projection and shielding the contacts.

7. The electrical connector as claimed in claim 1, wherein the insulative housing defines a plurality of passageways therein for receiving the contacts, the passageways comprising first passageways arranged in three parallel rows, parallel rows, second passageways, and third passageways crossed each other and positioned between the second passageways.

8. The electrical connector as claimed in claim 1, further comprising a board lock assembled to the insulative housing.

9. The electrical connector as claimed in claim 1, wherein the insulative housing defines a bore for receiving the sleeve, and wherein the front and the rear shielding members each define an opening for allowing the bolt to extend through.

10. The electrical connector as claimed in claim 9, wherein the rear shielding member comprises a wing having a forwardly extending arm portion and a hand portion extending perpendicular to the arm portion for abutting against the rear wall of the insulative housing, and wherein the opening of the rear shielding member is defined in the hand portion.

11. An electrical connector comprising:

an insulative housing defining opposite front and rear faces;

a plurality of contacts disposed in the housing with tail sections exposed outside of the rear face;

a front shielding covering the front face;

a rear shielding covering both the tail sections and the rear face; and a pair of screws extending through respective opposite lateral ends of all said front shielding, said rear shielding and said housing to secure the housing, the front shielding and the rear shielding together.

* * * * *